US005598884A

United States Patent [19]

Rouzeval et al.

[11] Patent Number: 5,598,884

[45] Date of Patent: Feb. 4, 1997

[54] DEVICE FOR GUIDING A CAST BAR FROM THE OUTPUT OF A CASTING WHEEL TO THE INPUT OF A ROLLING MILL

[75] Inventors: André Rouzeval, Conflans-Ste-Honorine; Christian Viel, Houilles, both of France

[73] Assignee: Clecim, Cergy-Pontoise, France

[21] Appl. No.: 478,580

[22] Filed: Jun. 7, 1995

Related U.S. Application Data

[62] Division of Ser. No. 137,421, Oct. 18, 1993, Pat. No. 5,484,010.

[30] Foreign Application Priority Data

Oct. 26, 1992 [FR] France ..... 92 12755

[51] Int. Cl.[6] ..... B22D 11/128

[52] U.S. Cl. ..... 164/448; 164/442

[58] Field of Search ..... 164/442, 441, 164/448, 447, 484

[56] References Cited

U.S. PATENT DOCUMENTS

| | | | |
|---|---|---|---|
| 3,548,920 | 12/1970 | Torban et al. | 164/442 X |
| 3,746,076 | 7/1973 | Baumann | 164/442 X |
| 3,911,995 | 10/1975 | Yu | 164/484 X |
| 4,214,623 | 7/1980 | Jaenson | 164/484 X |
| 4,290,479 | 9/1981 | Colombo | 164/448 |
| 4,703,792 | 11/1987 | Colombo et al. | 164/442 |
| 5,348,074 | 9/1994 | Streubel | 164/484 X |

FOREIGN PATENT DOCUMENTS

| | | | |
|---|---|---|---|
| 3150175 | 7/1982 | Germany | 164/442 |
| 3-258444 | 11/1991 | Japan | 164/448 |

*Primary Examiner*—J. Reed Batten, Jr.

*Attorney, Agent, or Firm*—Pollock, VandeSande & Priddy

[57] ABSTRACT

The device comprises an element for progressively taking charge of the strand, having at least one movable jaw which can move between a first, open position for introducing the tip of the strand and a second, closed position for centering the strand.

5 Claims, 3 Drawing Sheets

DEVICE FOR GUIDING A CAST BAR FROM THE OUTPUT OF A CASTING WHEEL TO THE INPUT OF A ROLLING MILL

This is a divisional of application Ser. No. 08/137,421 filed Oct. 18, 1993 and now U.S. Pat. No. 5,484,010.

BACKGROUND OF THE INVENTION

1. Field of the Invention

This invention relates to a device for guiding a continuously cast bar (called a strand) from a casting wheel in which it has been cast, up to the point it enters an installation for processing the strand.

2. Background Information

Wheel type strand continous casting machines traditionally comprise a casting wheel having a trapezoidal or triangular shaped grooved periphery, a metal strip being applied to a section of the said periphery so as to form a rotary mold.

The metal strip, produced in the form of an endless belt, is wound around return, pressure and tension pulleys which allow to apply the metal strip to that portion of the wheel periphery forming the mold.

A feed chute supplying molten metal is arranged at one of the points where the metal strip breaks contact with the casting wheel.

Spraying booms are arranged in front of the metal strip around the wheel periphery allowing to cool the rotary mold thus formed.

A device in the form of a knife, called an extractor, is installed at the other point where the metal strip breaks contact with the casting wheel in order to take off the solidified metal strand from the wheel.

The form of this strand produced continuously by the casting machine, is identical to that of the casting wheel groove, save for shrinkage due to the cooling of the metal.

The strand so cast is thereafter directed to a processing installation comprising, for example, a rolling mill associated with tensioning devices and other organs.

In particular, when casting begins, the tip of the strand must pass into an automatic or non-automatic shearing machine located in front of the processing installation and allowing to eliminate through cutting into pieces of short lengths all that part of the strand whose metallurgical quality has not reached the level required to undergo the rolling transformations.

The automatic shearing device generally consists of a set of rollers-pinchers whose upper roller, or rollers, withdraw sideways to allow the strand to be lowered, and a rotary drum shear whose vertically-arranged axes allow the strand to be lowered between the knives fixed onto the drums.

Once the reached metallurgical quality of the continuously cast strand is satisfactory, the rotary shear is stopped and the strand can then be directed to the rolling mill in which it is engaged in order to undergo successive continuous rolling operations, for example for the production of wire.

The operations of introducing the continuously cast strand into the shearing device and into the rolling mill are generally performed manually by operators who seize the strand with tongs as it leaves the casting wheel and guide it over the top of the wheel in order to introduce it into the shearing device or rolling mill located on the side facing the output of the wheel.

In a general way, since the curvature of the strand the moment it leaves the wheel is the same as the curvature of the wheel itself, the strand moves away from the extraction zone following a naturally curved path. The operator seizes the tip of the strand, makes it turn around the wheel and directs it to the input of the processing installation. Although the operator follows as much as possible the path taken naturally by the strand, this maneuver calls for a fair amount of physical strength because of the stiffness of the strand, and for some alloys several operators must be present.

In addition, because the shearing machine and rolling mill are located a certain distance from the wheel, the weight of the strand over its path from the wheel to the shears becomes fairly substantial. A support table is therefore placed upstream of the shears to form a rolling path on which the strand can rest. The strand may also become tensioned as it passes through the pinching rollers, and so to prevent it from flattening against the casting wheel, the rolling path is extended up to above the wheel following a profile corresponding to the path naturally taken by the strand as it leaves the wheel.

Clearly such a maneuver is not without risk for operators.

SUMMARY OF THE INVENTION

The object of the invention is arrangements for automatically guiding the strand without manual intervention from the casting wheel up to the shearing assembly, and consequently at lower cost and without placing operators at risk.

In addition, this guiding must be achieved in such a way as to not impede the strand as it emerges from the casting wheel and without altering the strand metallurgical qualities.

The invention therefore relates in a general way to a device for guiding a cast bar or strand, continuously produced by casting over a section of the periphery of a casting wheel driven in rotation, between a molten metal pouring zone and a zone where the strand is extracted, comprising a support table extending between the casting wheel and the input of an installation for processing the strand, said table passing underneath said entry point.

In accordance with the invention, immediately in front of the input to the rolling mill, the installation comprises means for seizing and guiding the strand arriving on the said rolling mill up to the input of said rolling mill.

The means for seizing and guiding the strand immediately in front of the input to the rolling mill comprise a lower table and an upper table of concave external shape, the upper table being articulated so as to pivot with respect to a frame that is itself fixed with respect to the lower table, the means comprising means for controlling the displacement of the upper table between an open position in which the-upper table and lower table mutually define a large opening, and a closed position in which the upper table pushes the strand against the lower table.

Brief Description of the Drawings The following description is purely illustrative and non-limiting. It must be read in conjunction with the attached drawings. In these drawings.

DESCRIPTION OF THE PREFERRED EMBODIMENTS

Figure 1:
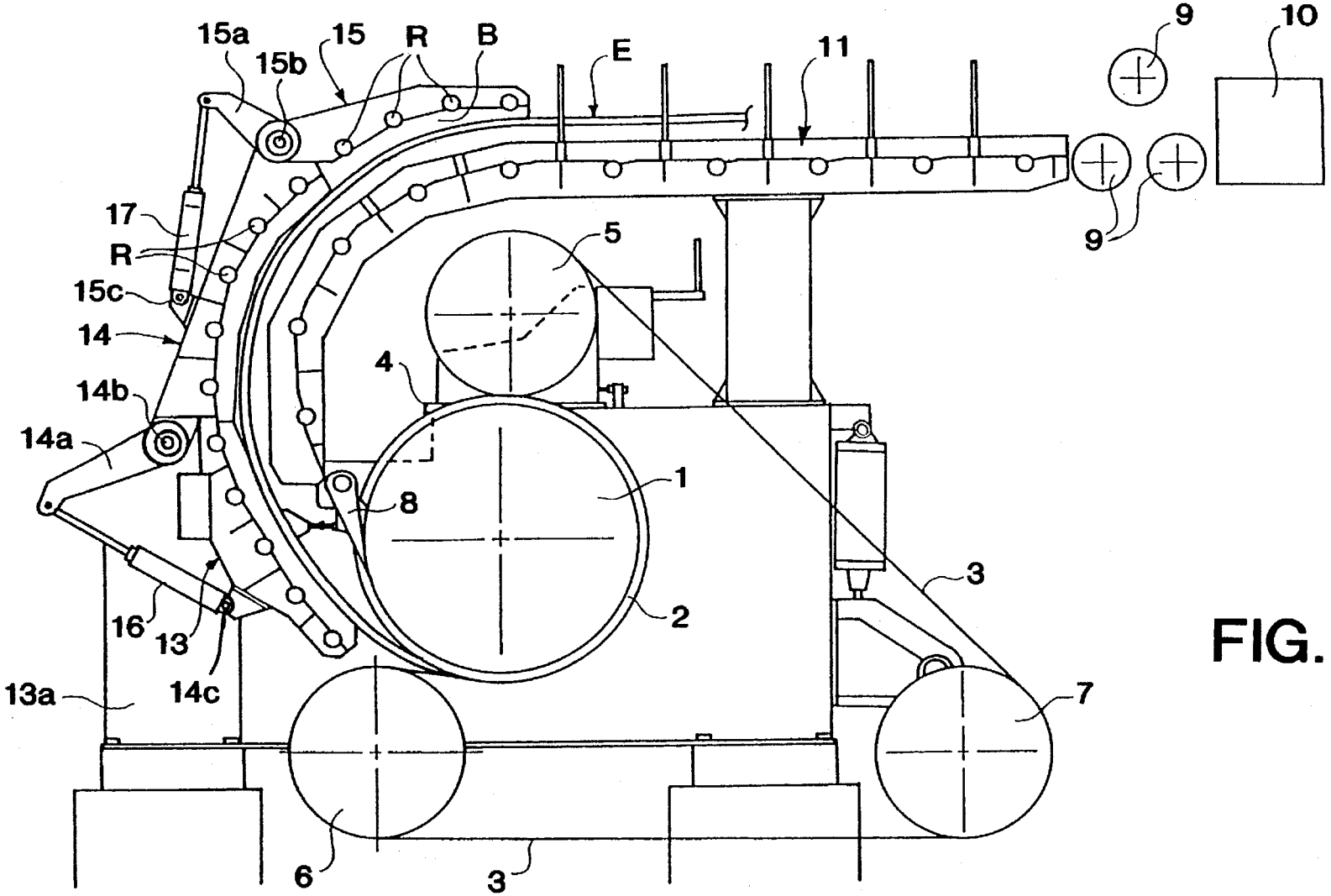
FIG. 1 is a schematic drawing of a casting machine fitted with an automatic guide device in accordance with co-pending application Ser. No. 08/137,421, only a first section of this device being shown in this figure.

FIG. 1 schematically shows a casting machine fitted with a guide device according to the invention, comprising a casting wheel 1 which has a groove 2 of trapezoidal cross-section, said casting wheel being covered by a metal strip 3 over approximately half of its periphery. Groove 2 and strip 3 thus form a mold in which the metal will be poured.

A feed chute 4 supplying molten metal is arranged at the upper section of wheel 1 on its upstream side in relation to its direction of rotation, said chute emerging substantially at the level of the zone of wheel 1 where the metal strip 3 comes into contact with its periphery. This chute 4 is used to feed molten metal into the input of the mold.

Strip 3 is a closed strip which partially covers the periphery of wheel 1. The said strip is pressed against the periphery of wheel 1 by a pressure wheel 5 and passes around two return wheels 6 and 7. Pressure wheel 5 is substantially tangent to the outer periphery of casting groove 2. It is arranged at the upper section of wheel 1, substantially at the level of feed chute 4 and slightly downstream of said chute 4 in relation to the direction of rotation of pressure wheel 5 which presses strip 3 against casting wheel 1. Return wheel 6 is arranged on the other side of casting wheel 1. Strip 3 passes onto said wheel 6 at the output of the mold. The return plane of strip 3, tangential to both wheel 1 and wheel 6, is substantially horizontal. On leaving wheel 6, strip 3 passes around wheel 7 and then around pressure wheel 5. The axes of return wheels 6 and 7 are arranged substantially in the same horizontal plane. The tension of metal strip 3 can be maintained by adjusting the position of return wheel 7 in a known way.

An extractor 8 is arranged in contact with the section of the periphery of wheel 1 that is not surrounded by strip 3, immediately beyond the zone where the said strip separates tangentially from wheel 1. This extractor 8 is designed to take off the cast strand, referenced E in the drawings, from wheel 1 and groove 2.

The point at which the strand unsticks from the wheel and the path it takes at this point depend on the nature of the metal, temperature and casting conditions. It can be noted, however, that the path taken naturally by the strand when it takes off from the wheel is generally in the form of an involute to a circle.

After leaving the casting wheel, strand E must be introduced into a processing installation comprising, for example, a rolling mill 12 preceded by a shearing assembly 9,10.

As mentioned above, a support table 11 is generally placed upstream of shearing assembly 9 to support the strand up to the point it enters the processing installation and to prevent it from returning towards the casting wheel, for example as a result of it being brought under tension. Table 11 extends between casting wheel 1 and shearing assembly #9, 10 below the path of the strand. Said table 11 comprises a first portion 11*a* which partially surrounds the casting wheel starting from extraction zone 8, and is prolonged in the downstream direction by a second portion 11*b*.

The guide device is made up of a series of guide tables placed one after another, for example three tables 13, 14 and 15. These three tables all have an inwardly curved shape towards the side of the casting machine. Table 13 is fixed with respect to the frame of the casting machine and is mounted, for example, on a vertical chassis 13*a*. Its lower end is arranged between extractor 8 and return wheel 6 close the region of the zone where strand E takes off from wheel 1, i.e. at the level of extractor 8 or possibly closer or further away from this point depending on the nature of the metal.

This fixed table 13 supports the two other tables 14 and 15 which are mobile with respect to the frame of the machine. At its upstream end, (in relation to the feed direction of strand E), table 14, or intermediate table, is articulated about a pivot axis 14*b* on the downstream end of table 13, i.e. the end of table 13 furthest from the unsticking zone. Pivot axis 14*b* is parallel to the axis of casting wheel 1. Table 14 is prolonged on the other side of axis 14*b* by an arm controlling the pivoting of axis 14*b*, said arm extending outwardly from the casting machine. The end of this pivoting control arm spaced from table 14 is articulated on the end of the rod of a jack 16 whose body is itself articulated on an anchoring point 14*c* arranged on a median section of table 13 towards the bottom of said table 13.

In the same way, the third table 15, or mobile end table, is mounted in articulated fashion so as to pivot about an axis 15*b* on intermediate table 14, and more precisely on the end downstream of the end opposite table 13. This table 15 is prolonged by an arm forming lever 15*a* similar to arm 14*a* and which extends outwardly starting from articulation axis 15*b*. The end of this arm 15*a* farthest from table 15 is articulated on the rod of a jack 17 whose body is itself articulated about an axis 15*c* on a central section of table 14.

The three tables 13, 14 and 15 are formed in a similar way. Each comprises a steel welded chassis on which a series of anti-friction rollers R is mounted. On each table 13, 14, 15, these rollers define a guide surface curved inwardly towards the machine, and which is limited on either side of rollers R by two lateral edges B such that each table 13, 14, 15 forms a portion of channel G of U-shaped cross-section open on the side of wheel 1.

The channel defined by the said tables for strand E leaving casting wheel 1 will be more or less inwardly curved depending on the positions of jacks 16 and 17. In the closed position shown in FIG. 1, tables 13, 14 and 15 are arranged in such a way that the inwardly curved surfaces defined by the rollers connect tangentially, the curvature of the channel being substantially continuous from the lower end of table 13 to the upper end of table 15 from where strand E leaves table 15 substantially horizontal.

Figure 3:
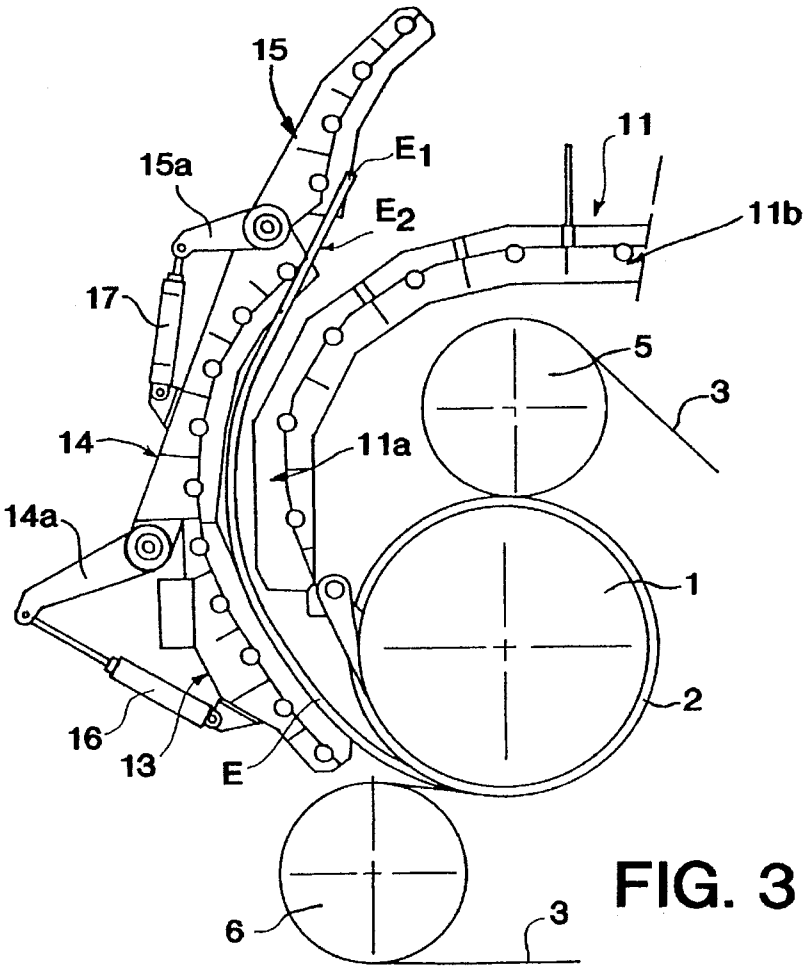
FIGS. 2 and 3 are partial schematic drawings of the casting machine shown in FIG. 1 and of the guide device, in different stages of operation of the device.
Figure 2:
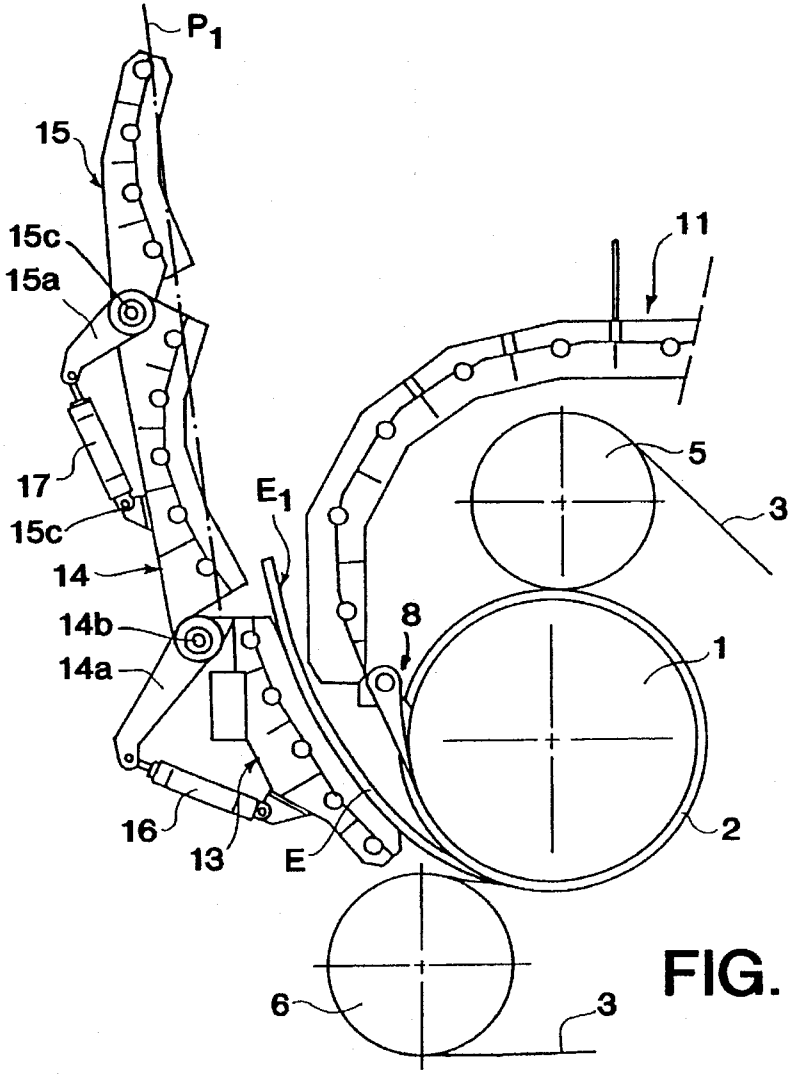

In the open position, the upstream and downstream end rollers of each mobile table 14, 15 define a plane substantially parallel to the plane tangent to the guide surface of the preceding table at its downstream end, all the other rollers being offset outside of this plane. Thus, in the case of FIG. 2, the end rollers of table 14 define a plane P1 directed along the tangent to the output of table 13. In the case of FIG. 3, the outer rollers of table 15 define a plane P2 parallel to the tangent to the output of table 14 in the closed position.

In their closed position, guide tables 13, 14, 15 therefore determine an outer guide face, inwardly curved along a curve parallel to the first section 11*a* of the transfer table, which thus closes towards the inside of guide channel G, and whose curvature can also be more accentuated than that of the path taken naturally by the strand for certain alloys when manually transferred. The first section 11*a* of the transfer table can therefore be closer to the casting wheel than in prior art installations, with closed channel G connecting tangentially to the second section 11*b* of the support table 11 which is directed towards the shearing assembly 9 and shear 10.

Figure 4:
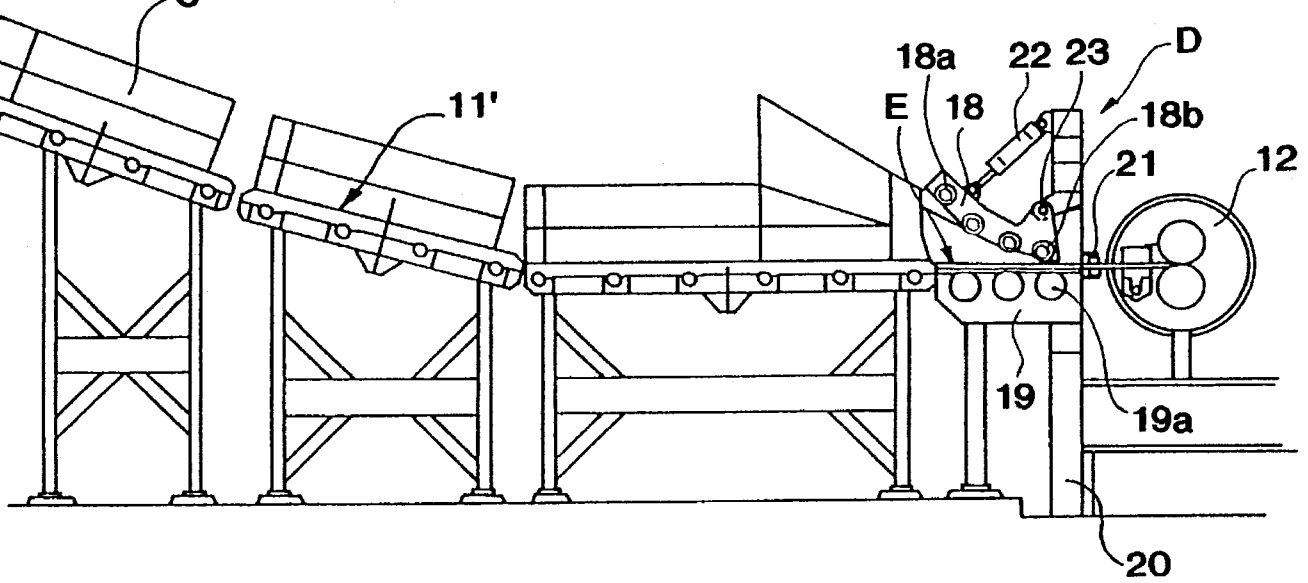
FIG. 4 is a schematic drawing of the second section of the device according to the invention.

Reference will now be made more particularly to FIG. 4 which shows the section of the installation extending beyond the shearing assembly 9–10. The support table for strand E is prolonged by a transfer table 11' up to a device D designed, for example, to engage strand E in a rolling mill 12. This portion of table 11' is associated with guide means C. Device D mainly comprises a lower table 19 and an upper table 18 which are mounted on a support frame 20. The input to the rolling mill is traditionally fitted with a roller guide 21. Lower table 19 is made from welded steel and comprises a series of smooth roller wheels 19*a* with parallel axes of which at least one is driven in rotation about its axis by a motor, via a free-wheel coupling and pinion cage (not shown). Upper table 18 is also made from welded steel and comprises a number of idle rollers 18*a* with parallel axes, arranged along a curved surface convex to the support table so as to form a guide space enlarged on the side that receives strand E arriving from transfer table 11', and which becomes progressively narrower towards input rollers 21. This table 18 can swing about an articulation axis 23 arranged above rollers 18*a* at the end of support frame 20 and which faces the input of rolling mill 12. A jack 22 bearing on the upper part of frame 20 is articulated on table 18 towards the end of said table 18 facing channel G, and is used to swing table 18 about its axis 23, rollers 18*a* taking up the position shown in FIG. 5.

Figure 5:
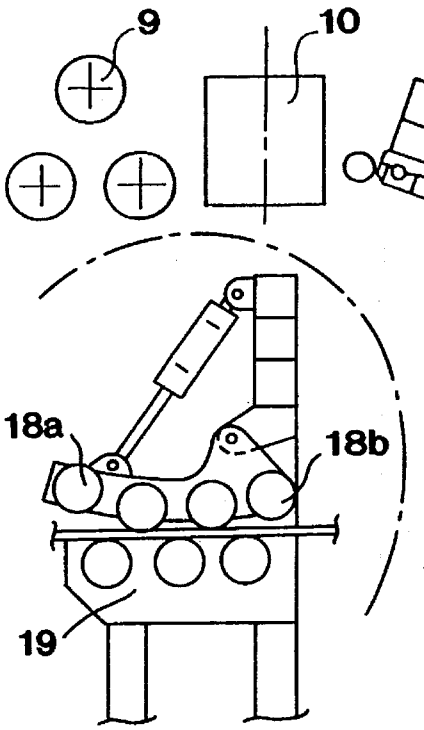
FIG. 5 is a detailed, large-scale view of the device for engaging the strand.

When table 18 is in the open position, the roller 18*b* at its downstream end is vertically aligned with articulation axis 23 and works with the last roller wheel 19*a* of lower table 19 to pinch the end of the strand when it arrives and to direct it towards input rollers 21. Jack 22 then pivots upper table 18 causing downstream roller 18*b* to rise as shown in FIG. 5. The other rollers of upper table 18 are arranged so as to take up position between the rollers of lower table 19. The strip therefore undergoes an aligning action when it engages in rolling mill 12.

The working of such a device will now be described. At the time casting begins, tables 14 and 15 are both in the open position in their positions shown in FIG. 2, jacks 16 and 17 being retracted. When the tip of strand E arrives at the level of extractor 8, it detaches from groove 2 of casting wheel 1 and moves towards table 13 following the curved profile of table 13 which corresponds substantially to the path taken naturally by the strand. At the output of table 13, the strand tends to continue tangentially along a substantially straight line parallel to plane P1, traveling upwardly along the first mobile table 14, the assembly now being in the open position. When the tip of strand E reaches the upper end of mobile table 14, the operator swings the said table inwardly (FIG. 3). Strand E is now trapped between the ramp formed by the said support table and intermediate table 14. It continues its forward movement while maintaining on the inside of tables 13 and 14 the curvature which it has thus been given. Starting from the upper end of mobile table 14, the strand is no longer guided, and for as long as the weight of the upstream part, considering its stiffness, is insufficient to make it bend, the said upstream part continues its forward movement in a more or less straight line tangent to the curve formed by table 14 closed in order to move up along mobile table 15 which is now in the open position. When the tip of strand E reaches the level of the last roller of mobile table 15, table 15 is folded inwardly to the position shown in FIG. 1. Strand E is then completely trapped in closed channel G limited on the outer side by successive tables 13, 14 and 15, and on the inner side by support table 11. It leaves the guide channel G thus defined and passes onto the second section 11*b* of support table 11 which follows a substantially horizontal or slightly inclined direction, allowing easy and immediate engagement in the roller-pincher 9/shear 10 assembly.

By folding mobile tables 14 and 15 after the tip of the strand has passed, it is possible to curve the strand without subjecting it to longitudinal stresses, the curving being effected by a given lever arm and applied on a zone away from the tip. This avoids any holding back of the forward movement of the solidified part of the metal.

The emergence of the strand along a horizontal or slightly inclined plane makes it easier to engage the strand in the pincher-shear assembly, and avoids having to engage the strand from above which is always a difficult operation.

Rollers-pinchers 9, which are initially spaced from the zone through which the strand must pass, close on the tip of the strand when it arrives at their level, shear 10 then starting up. Once the metallurgical quality of the strand is satisfactory, rotary shear 10 is stopped, and strand E is sent via transfer table 11' to device D designed to engage the strand in rolling mill 12. Upper table 18 is initially in the wide open position represented in FIG. 4 by a solid line. Rollers 19*a* on the lower table are driven in rotation in the feed direction of strand E. Once strand E is engaged in the opening of device D, jack 22 closes upper table 18 onto upper table 18 causing lower table 19 to swing about its articulation axis 23.

This rotation of table 18 is controlled at a speed corresponding to the speed of strand E in such a way that through the progressive action of jack 22, rollers 18*a* of the upper table 18 come into contact with strand E one after the other and straighten the tip of the strand so as to facilitate its engagement in rolling mill 12, rollers 18*a* being positioned so as to form a line substantially tangential to the horizontal plane and separated from table 19 by a height substantially corresponding to the thickness of strand E. Strand E is therefore progressively guided between tables 18 and 19 up to input rollers 21 of rolling mill 12.

In addition, when upper table 18 is open, the most downstream roller 18*b* is vertically in line with axis of rotation 23. Roller 18*b* therefore rises slightly when upper table 18 closes. This vertical position of roller 18*b* makes it possible to tangentially push the tip of the strand on engagement and then release it when it arrives at roller wheels 21 for lateral centering along the rolling axis. This release provides the possibility of repositioning the strand, as the case may be, at the time of its engagement.

All the arrangements described above therefore allow a reduction to be made in the number of operators required to engage the beginning of a casting machine and remove danger from the operation.

However, the two parts of the invention, namely, the progressively curved guide channel 13, 14, 15 and the engagement table 18, each have their own specific advantages and could therefore be advantageously used separately. For example, for modifications made to an existing installation, it could suffice to automate the guiding of the strand around the casting wheel.

What is claimed:

1. A device for guiding a continuously cast strand from a casting wheel to an installation for processing said strand, wherein said strand is supported by a support table during its movement from said casting wheel to said processing installation, said device comprising means for progressively taking charge of said strand for its input into said processing installation, said means comprising a lower and an upper table, said upper table being made up of a chassis articulated about an axis that is horizontal and perpendicular to a feed direction of said strand, said chassis having a convex outer surface facing said strand, and means for controlling the rotation of said chassis about said axis as said strand advances, between a first open position in which said upper table and said lower table jointly define a large opening and a second closed position, in which said upper table pushes said strand against said lower table, said convex surface of said upper table forming a jaw which is open in said first open position of said chassis for introduction of a tip of said strand and which is closed in said second closed position for centering said strand, said means for controlling the rotation of said chassis gradually closing said jaw and straightening said strand from said first open position to said second closed position.

2. The device according to claim 1, wherein said convex outer surface is made up of a plurality of rollers having axes parallel to said articulation axis of said chassis and being arranged along a substantially circular curved line centered on said axis.

3. The device according to claim 2, wherein a most downstream roller is in substantially vertical alignment with said axis when said upper table is in open position, so that said most downstream roller rises slightly on releasing said strand when said upper table moves into closed position by rotation about said axis.

4. The guide device according to claim 3, wherein said lower table comprises a plurality of roller wheels defining a horizontal feed plane of said strand, said upper table comprising rollers which take up position, respectively, between said roller wheels of said lower table, a spacing of said roller wheels and said rollers being predetermined to produce a straightening action on said strand.

5. A device for guiding a continuously cast strand from a casting wheel to an installation for processing said strand, wherein said strand is supported by a support table during its movement from said casting wheel to an arrangement for engaging said strand into said processing installation, said device comprising means for progressively taking charge of said strand, said means comprising a lower table and an upper table associated with means for controlling displacement of said upper table between an open position in which said upper table and said lower table jointly define a large opening, and a closed position in which said upper table pushes said strand against said lower table, said upper table having a convex outer surface forming a jaw which is movable between a first position in which said jaw is open for introduction of a tip of said strand and a second position in which said jaw is closed for centering said strand, and means for gradually closing said jaw and straightening said strand from said first to said second position.

* * * * *